US010127856B2

(12) United States Patent
Lee et al.

(10) Patent No.: US 10,127,856 B2
(45) Date of Patent: Nov. 13, 2018

(54) DISPLAY APPARATUS AND CONTROL METHOD THEREOF

(71) Applicant: SAMSUNG ELECTRONICS CO., LTD., Suwon-si (KR)

(72) Inventors: Sang-hoon Lee, Suwon-si (KR); Myoung-jun Lee, Bucheon-si (KR); Eun-il Cho, Suwon-si (KR); Byeong-cheol Hyeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 541 days.

(21) Appl. No.: 14/168,115

(22) Filed: Jan. 30, 2014

(65) Prior Publication Data

US 2014/0218421 A1 Aug. 7, 2014

(30) Foreign Application Priority Data

Feb. 5, 2013 (KR) ..... 10-2013-0012813

(51) Int. Cl.
*G09G 3/20* (2006.01)
*G09G 3/3208* (2016.01)
*G09G 3/3225* (2016.01)

(52) U.S. Cl.
CPC ..... *G09G 3/3208* (2013.01); *G09G 3/2011* (2013.01); *G09G 3/2025* (2013.01); (Continued)

(58) Field of Classification Search
CPC ..... G09G 3/2018; G09G 3/2081; G09G 3/20; G09G 3/3208
See application file for complete search history.

(56) References Cited

U.S. PATENT DOCUMENTS 5,748,160 A * 5/1998 Shieh ..... G09G 3/2011 345/210
5,818,419 A * 10/1998 Tajima ..... G09G 3/2033 345/213

(Continued)

FOREIGN PATENT DOCUMENTS

CN 101354866 A 1/2009
EP 1096465 A2 5/2001

(Continued)

OTHER PUBLICATIONS

Communication dated May 6, 2014 issued by the European Patent Office in counterpart European Patent Application No. 14153490.9.

(Continued)

*Primary Examiner* — Alexander Eisen
*Assistant Examiner* — Mansour M Said
(74) *Attorney, Agent, or Firm* — Sughrue Mion, PLLC

(57) ABSTRACT

Disclosed are a display apparatus and a control method thereof, the display apparatus including: a display unit which includes a plurality of pixels with an organic light emitting diode (OLED); a power supply which supplies power to the display unit; an image processor which processes an image signal in accordance with the plurality of pixels; and a controller which divides the frame into a plurality of sub-frames, assigns bit weights to each of the divided sub-frames, and controls the power supply to supply a voltage which is adjusted by the assigned bit weights in accordance with the sub-frames to the display unit.

32 Claims, 14 Drawing Sheets

(52) U.S. Cl.
CPC ..... *G09G 3/2081* (2013.01); *G09G 3/3225* (2013.01); *G09G 2300/0819* (2013.01); *G09G 2310/0243* (2013.01); *G09G 2330/028* (2013.01)

(56) References Cited

U.S. PATENT DOCUMENTS

| | | | | |
|---|---|---|---|---|
| 5,990,629 | A * | 11/1999 | Yamada | G09G 3/2011 257/71 |
| 6,777,886 | B1 | 8/2004 | Lo et al. | |
| 2006/0082525 | A1* | 4/2006 | Suzuki | G09G 3/2022 345/77 |
| 2006/0284894 | A1* | 12/2006 | Johnson | G09G 3/2022 345/690 |
| 2008/0007546 | A1 | 1/2008 | Kawabe | |
| 2008/0111777 | A1 | 5/2008 | Kim | |
| 2009/0021455 | A1 | 1/2009 | Miller et al. | |
| 2009/0027311 | A1 | 1/2009 | Lee et al. | |
| 2009/0085896 | A1* | 4/2009 | Nagase | H04N 19/147 345/204 |
| 2009/0244050 | A1* | 10/2009 | Yamamoto | G09G 3/3233 345/212 |
| 2010/0033408 | A1* | 2/2010 | Kawabe | G09G 3/2022 345/76 |
| 2010/0141646 | A1* | 6/2010 | Tanabe | G09G 3/2022 345/214 |
| 2011/0080441 | A1* | 4/2011 | Wacyk | G09G 3/2081 345/691 |
| 2011/0084993 | A1 | 4/2011 | Kawabe | |
| 2013/0201223 | A1* | 8/2013 | Li | G09G 3/2022 345/690 |
| 2014/0300594 | A1* | 10/2014 | Aubert | G09G 3/348 345/212 |

FOREIGN PATENT DOCUMENTS

| | | |
|---|---|---|
| TW | 200822044 | 5/2008 |
| WO | 9833165 A1 | 7/1998 |

OTHER PUBLICATIONS

Communication dated Apr. 1, 2017 by the State Intellectual Property Office of P.R. China in counterpart Chinese Patent Application No. 201410038999.9.

Communication dated Jun. 27, 2017, issued by the European Patent Office in counterpart European Patent Application No. 14153490.9.

Communication dated May 3, 2018, issued by the European Patent Office in counterpart European Patent Application No. 14153490.9.

* cited by examiner

DISPLAY APPARATUS AND CONTROL METHOD THEREOF

CROSS-REFERENCE TO RELATED APPLICATION

This application claims priority from Korean Patent Application No. 10-2013-0012813, filed on Feb. 5, 2013, in the Korean Intellectual Property Office, the disclosure of which is incorporated herein by reference in its entirety.

BACKGROUND

Field

Apparatuses and methods consistent with the exemplary embodiments relate to a display apparatus and a control method thereof, and more particularly, to a display apparatus provided with a display unit using an organic light emitting diode (OLED) and a control method thereof.

Description of the Related Art

Generally, application fields of a display apparatus using an organic light emitting diode (OLED), that is an organic electroluminescence display apparatus, have recently been expanded from a lightweight and small mobile display apparatus to a large-sized display apparatus.

An OLED display apparatus uses an OLED, i.e., a self-emissive device that can emit light by itself and therefore does not need a separate backlight unit for providing light in a rear of a liquid crystal display (LCD) panel Accordingly, the OLED display apparatus advantageously becomes thinner as much as the backlight unit is not used.

Typically, the OLED display apparatus has a configuration in which R, G and B OLEDs are arranged between a single source voltage ELVDD provided from a power supplying terminal and a ground voltage ELVSS of the power ground terminal and a switching device such as a field effect transistor (FET) is connected between each OLED and the source voltage.

FIG. 1 is a circuit diagram for supplying power to an OLED display apparatus, and FIG. 2 is a view for explaining a conventional driving operation in the circuit diagram of FIG. 1.

As shown in FIG. 1, the OLED display apparatus includes light emitting cells (OLED (R), OLED (G) and OLED (B)) respectively corresponding to red, green, and blue (or red, green, blue, and white), and a plurality of transistors (e.g., a thin film transistor (TFT)). The OLED display apparatus is classified into a Passive Matrix Organic Light-Emitting Diode (PM-OLED) and an Active Matrix Organic Light-Emitting Diode (AM-OLED) in accordance with driving methods. In the AM-OLED display apparatus, a driving operation is divided into an address section (ads) for writing brightness information about the light emitting cell and a light section (light) for displaying actual brightness based on information written during the address section (ads).

Referring to FIG. 1, S1 is set to Low during the address section (ads) so that capacitors C1, C2, and C3 are charged with electric charges corresponding to brightness, and the light emitting cells (OLED (R), OLED (G) and OLED (B)) emit light during the light section (light) by the electric charges charged in the capacitors C1, C2, and C3 during the address section (ads).

Here, each of the RGB light emitting cells uses ELVDD as a common driving voltage, in which a forward current $I_f$ corresponding to setup brightness flows during the light section (light), and a forward voltage drop $V_f$ occurs between both ends of each RGB light emitting cells, as shown in FIG. 2.

Due to the forward current and the forward voltage drop, a voltage corresponding to (ELVDD-$V_f$) is applied to both ends of each of the switches (M1, M3, and M5), and power loss corresponding to (ELVDD-$V_f$)×$I_f$ occurs in the switches (M1, M3, and M5). The power loss is converted into heat, and a temperature of the panel is increased, thereby a waste of power consumption is increased.

Here, the forward voltage drop $V_f$ is a function of the forward current $I_f$ flowing in the RGB light emitting cells, and the brightness of each of the RGB light emitting cells is also a function of the forward current $I_f$. Therefore, the power loss is affected by the setup brightness of the respective RGB light emitting cells. Each of the RGB light emitting cells has different characteristic of the forward voltage drop $V_f$. Generally, it is in an order of B, G and R, and thus ELVDD is determined with respect to the B OLED cell having the highest $V_f$. Accordingly, as shown in FIG. 2, more power loss occurs in the G and R OLED cells rather than the brightest B OLED cell.

Also, a conventional OLED display apparatus is driven in the state that the common driving voltage ELVdd is fixed to the maximum grayscale of a certain pixel (e.g., 15 gs of the B pixel shown in FIG. 2) regardless of an input image. Therefore, as shown in FIG. 2, if a setup brightness of a cell is decreased, the power loss is gradually increased.

Accordingly, in the conventional OLED display apparatus using the common driving voltage ELVdd, there is a need of minimizing the power loss occurring in accordance with the characteristics of the respective light emitting cells.

SUMMARY

According to an aspect of an exemplary embodiment, there is provided a display apparatus, the display apparatus including: a display unit which includes a plurality of pixels with an organic light emitting diode (OLED); a power supply which supplies power to the display unit; an image processor which processes an image signal to be displayed on the display unit in accordance with the plurality of pixels; and a controller which divides one frame into a plurality of sub-frames, assigns bit weights to each of the divided sub-frames, and controls the power supply to supply a voltage which is adjusted by the assigned bit weights in accordance with the sub-frames to the display unit.

The number of sub-frames constituting one frame may correspond to the number of driving bits for the image signal.

The bit weight may be determined according to a grayscale of a pixel of a corresponding frame.

The display apparatus may further includes a storage unit to store a lookup table in which a voltage level or a current level corresponding to the bit weight assigned in accordance with the grayscale of the pixel is set up.

The controller may control the power supply to supply a voltage of a pixel to which the highest bit weight is assigned among the plurality of pixels as a common voltage during a sub-frame section of the plurality of pixels.

The controller may assign the bit weight so that the sub-frame has a maximum voltage in a most significant bit section of the sub-frame and a minimum voltage in a least significant bit section of the sub-frame.

The controller may assign the bit weight so that a voltage of the sub-frame corresponds to half a voltage of a previous sub-frame.

The controller may assign the bit weight so that the sub-frame has a maximum voltage in a least significant bit section of the sub-frame and a minimum voltage in a most significant bit section of the sub-frame.

The controller may assign the bit weight so that the number of change for a voltage of the sub-frame with respect to a voltage of a previous sub-frame is minimized.

The controller may assign the bit weight so that a difference in voltage between a previous sub-frame and the sub-frame is minimized.

The sub-frame may include an address section where a voltage is changed and a light section where a pixel emits light.

The sub-frame may include a voltage build section where a voltage is changed, an address section where the changed voltage is stabilized, and a light section where a pixel emits light.

The controller may control the power supply to readjust voltage by adding a predetermined setup value to a level of the adjusted voltage.

According to an aspect of another exemplary embodiment, there is provided a control method for controlling a display apparatus including a display unit with an organic light emitting diode (OLED), the method including: dividing a frame of an image signal into a plurality of sub-frames in accordance with a plurality of pixels; assigning a bit weight to each of the divided sub-frames; adjusting a voltage supplied to the display unit by the assigned bit weight in accordance with the sub-frames; and processing the image signal based on the adjusted voltage in accordance with the sub-frames.

The number of sub-frames constituting one frame may correspond to the number of driving bits for the image signal.

The bit weight may be determined according to a gray scale of a pixel of a corresponding frame.

The adjusting the voltage may include referring to a lookup table in which a voltage level or a current level corresponding to the bit weight assigned in accordance with the gray scale of the pixel is set up.

The adjusting the voltage may include supplying a voltage of a pixel to which the highest bit weight is assigned among the plurality of pixels as a common voltage during a sub-frame section of the plurality of pixels.

The assigning the bit weight may include assigning the bit weight so that the sub-frame has a maximum voltage in a most significant bit section of the sub-frame and a minimum voltage in a least significant bit section of the sub-frame.

The assigning the bit weight may include assigning the bit weight so that a voltage of the sub-frame corresponds to half a voltage of a previous sub-frame.

The assigning the bit weight may include assigning the bit weight so that the sub-frame has a maximum voltage in a least significant bit section of the sub-frame and a minimum voltage in a most significant bit section of the sub-frame.

The assigning the bit weight may include assigning the bit weight so that the number of changes for a voltage of the sub-frame with respect to a voltage of a previous sub-frame is minimized.

The assigning the bit weight may include assigning the bit weight so that a difference in voltage between a previous sub-frame and the sub-frame is minimized.

The sub-frame may include an address section where a voltage is changed and a light section where a pixel emits light.

The sub-frame may include a voltage build section where a voltage is changed, an address section where the changed voltage is stabilized, and a light section where a pixel emits light.

The method may further include readjusting voltage by adding a predetermined setup value to a level of the adjusted voltage.

According to an aspect of another exemplary embodiment, there is provided a circuit for a display apparatus having a plurality of pixels, the circuit comprising: an image processor which processes an image signal in accordance with the plurality of pixels; and a controller which divides a frame of the image signal into a plurality of sub-frames, assigns bit weights to each of the divided sub-frames, and supplies a voltage which is adjusted by the assigned bit weights in accordance with the sub-frames to the display apparatus.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION OF EXEMPLARY EMBODIMENTS

Below, exemplary embodiments will be described in detail with reference to the accompanying drawings.

The exemplary embodiments described herein, such as a detailed construction and elements thereof, are provided to assist in a comprehensive understanding of this description. Thus, it would be appreciated by those of skill in the art that changes may be made to these embodiments without departing from the principles and spirit of the inventive concept. Also, well-known functions or constructions are omitted to provide a clear and concise description of exemplary embodiments. Further, dimensions of various elements in the accompanying drawings may be arbitrarily increased or decreased for assisting in a comprehensive understanding.

Figure 3:
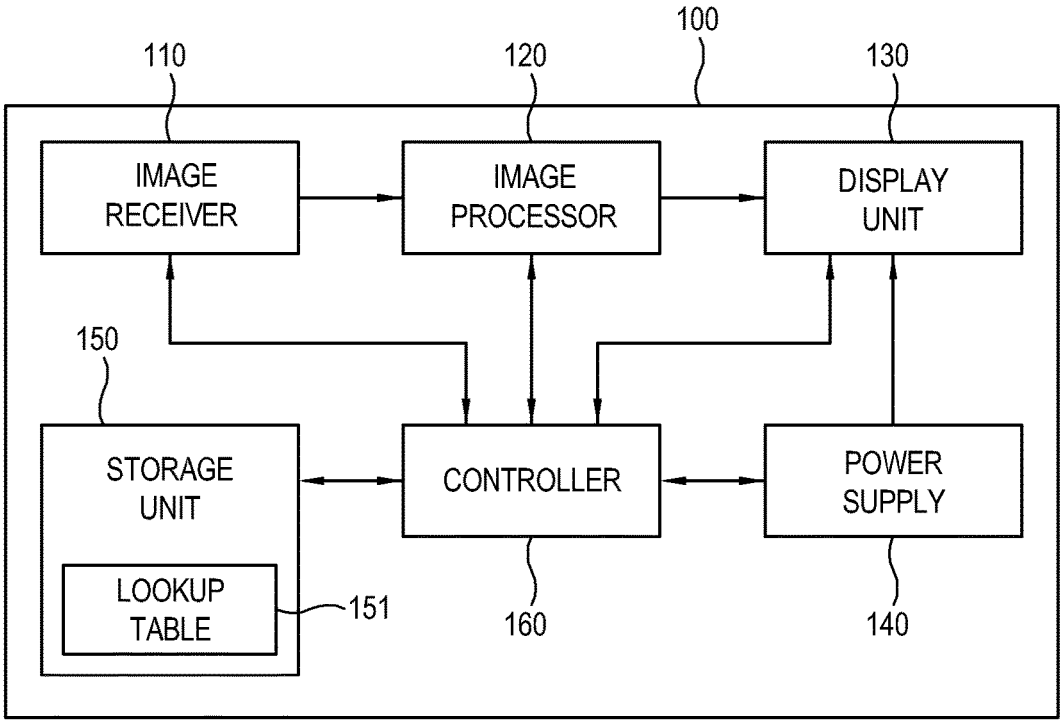
FIG. 3 is a block diagram showing a configuration of a display apparatus according to an exemplary embodiment.

FIG. 3 is a block diagram showing a configuration of a display apparatus 100 according to an exemplary embodiment.

As shown in FIG. 3, the display apparatus 100 processes an image signal, i.e., a video signal, provided form an external image source (not shown) in accordance with a preset imaging process, and displays the processed image signal as an image.

While not restricted thereto, the display apparatus 100 in this embodiment is achieved by a television (TV) which processes a broadcasting image based on a broadcasting signal/information/data received from a broadcasting station. The display apparatus 100 may be realized as various types of display apparatuses including a monitor, a personal computer (PC), a projection television, a tablet PC, a mobile phone, etc.

Also, the type of image displayable in the display apparatus 100 is not limited to the broadcasting image. For example, the display apparatus 100 may perform processes for an image such as a moving picture, a still picture, an application based on a signal/data received from various image sources, an on-screen display (OSD), a graphic user interface (GUI) for various operation controls, etc.

According to an exemplary embodiment, the display apparatus 100 may be achieved by a smart TV which is capable of receiving and displaying a broadcasting signal in real time, and has a web browser function for enabling searching and consumption for various contents through Internet simultaneously with displaying of a broadcasting signal in real time. Also, the smart TV includes an open software platform and is thus capable of providing interactive service to a user. Therefore, the smart TV may provide a user with various contents, for example, an application for offering a predetermined service through the open software platform. The application is an application program that may provide various kinds of services, such as a social network service (SNS), finance, news, weather, map, music, movie, game, electric book, etc.

As shown in FIG. 3, the display apparatus 100 includes an image receiver 110 for receiving an image signal, an image processor 120 for processing the image signal received in the image receiver 110, a display unit 130 for displaying an image based on the image signal processed by the image processor 120, a power supply 140 for supplying power to respective components of the display apparatus 100, a storage unit 150 for storing various data/information therein, and a controller 160 for controlling general operations of the display apparatus 100.

The image receiver 110 receives an image signal and transmits the image signal to the image processor 120. For example, the image receiver 110 may receive a radio frequency (RF) signal in a wireless manner transmitted from a broadcasting station (not shown), or receives image signals in a wired manner according to standards such as composite image, component image, super image, Syndicat des Constructeurs d'Appareils Radiorécepteurs et Téléviseurs (SCART), high definition multimedia interface (HDMI), etc. If the image signal is the broadcasting signal, the image receiver 110 includes a tuner to tune the broadcasting signal by channel.

The image signal may be received from an external device, e.g., a personal computer (PC), an audio/image (AV) device, a smart phone, a smart pad, etc. The image signal may be data received through a network such as the Internet. In this case, the display apparatus 100 may further include a network communication unit (not shown) to perform a communication through the network. Alternatively, the image signal may be data stored in the storage unit 150, e.g., a flash memory, a hard disk drive (HDD), etc. The storage unit 150 may be provided inside or outside the display apparatus 100. If the storage unit 150 is provided outside the display apparatus 100, a connector (not shown) may be provided to connect with the storage unit 150.

The image processor 120 performs various image processing operations previously set with respect to the image signal, and outputs the processed image signal to the display unit 130.

The image processing operations of the image processor 120 may include, but are not limited thereto, a decoding operation, a de-interlacing operation, a frame refresh rate conversion, a scaling operation, a noise reduction operation for improving an image quality, a detail enhancement operation, a line scanning operation, etc. The image processer 120 may be achieved by individual groups which independently perform the foregoing operations, or by a system on chip (SOC) which performs integrated.

The image processor 120 processes an image signal to be displayed in accordance with a plurality of pixels on the display unit 130 (to be described later).

The display unit 130 displays an image based on the image signal processed by the image processor 120. The display unit 130 in this embodiment may be achieved by a display apparatus using an organic light emitting diode (OLED), that is, an organic electroluminescence display.

Figure 1:
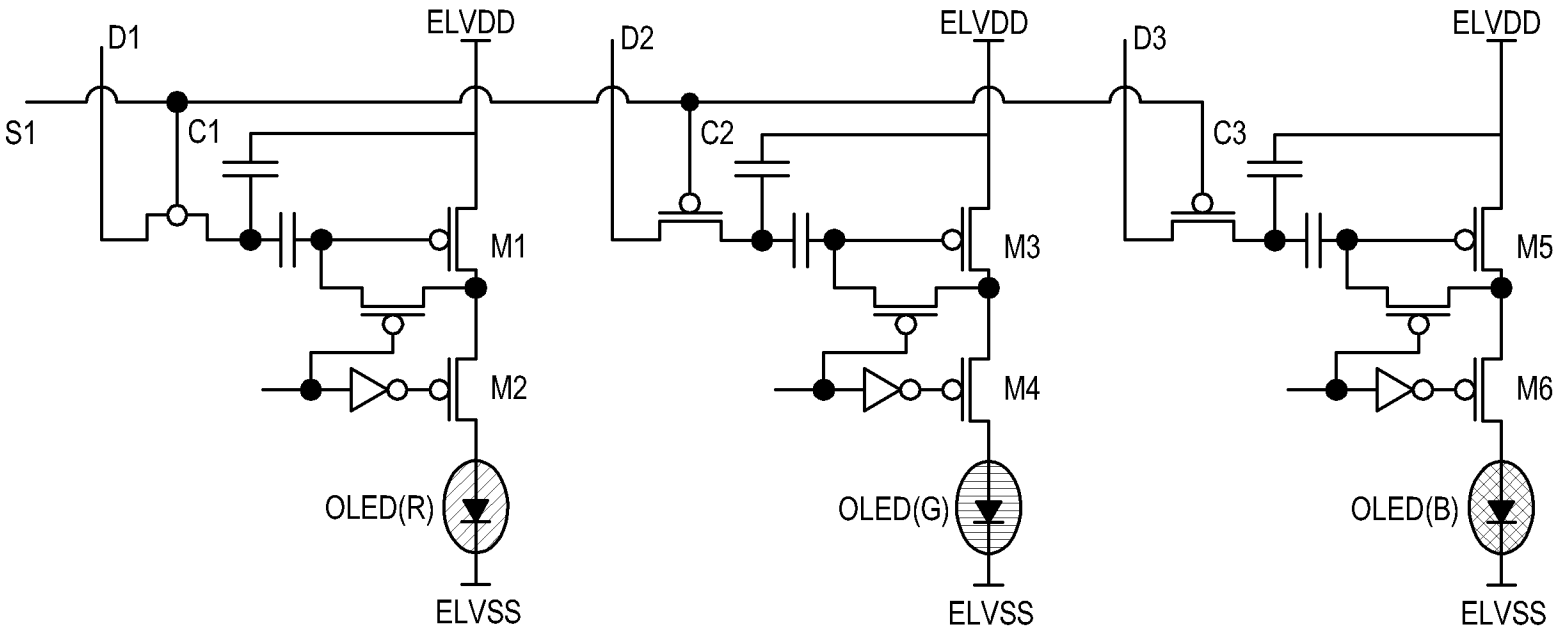
FIG. 1 is a circuit diagram illustrating a power supply in an OLED display apparatus.
Figure 2:
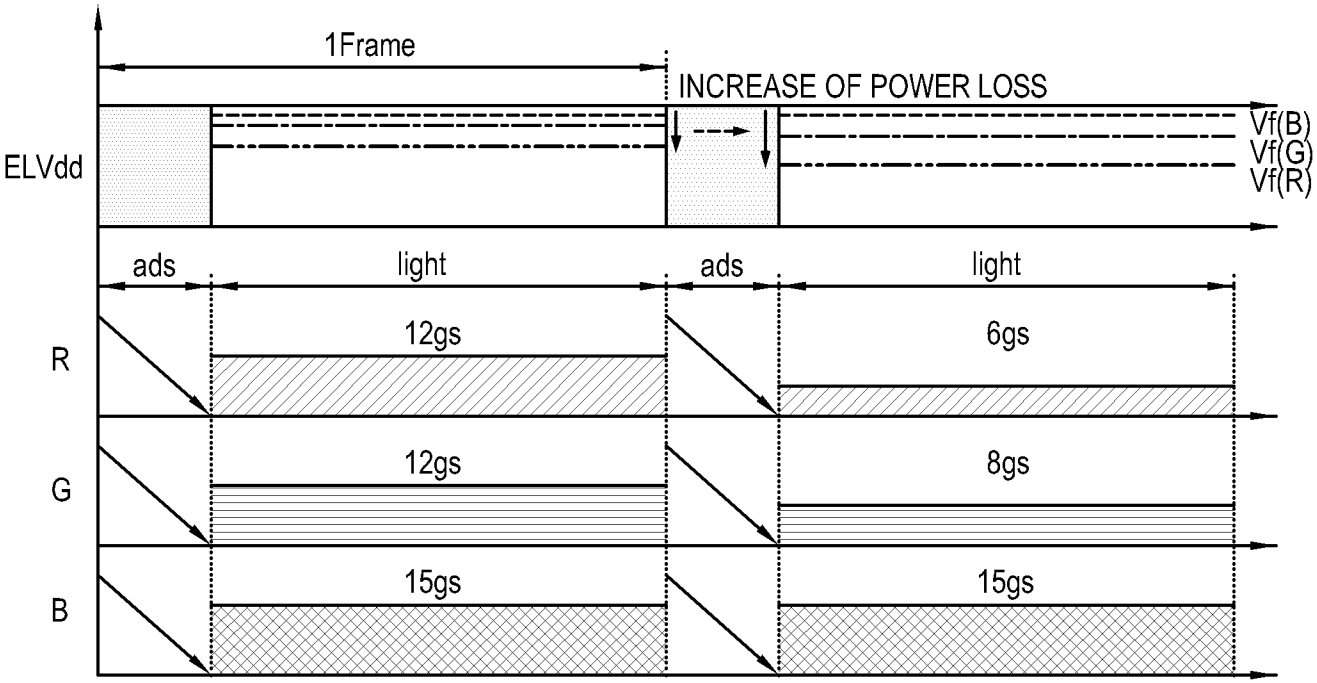
FIG. 2 is a view for explaining a conventional driving operation in the circuit diagram of FIG. 1.

A display panel (not shown) of the display unit 130 includes a plurality of pixels arranged in the form of a matrix having rows and columns. As shown in FIG. 1, the plurality of pixels may include light emitting cells (OLED (R), OLED (G), OLED (B)) made of an OLED, and a cell driver for independently driving each light emitting cell.

The power supply 140 supplies power to the display panel of the display unit 130 in response to a control signal from the controller 160 (to be described later). The power supply 140 is provided separately from the display unit 130, but there is no limit to the power supply of this embodiment. Alternatively, the power supply may be incorporated into the display unit 130.

The storage unit 150 stores data under control of the controller 160. For example, the data stored in the storage unit 150 may include not only an operating system for operating the display apparatus 100 but also various applications executable in the operating system, image data, additional data, etc.

The storage unit 150 may further store a lookup table (LUT) 151 where a current or voltage level corresponding to a bit weight assigned in accordance with gray scales of a pixel is set up. The controller 160 reads the current or voltage level corresponding to the bit weight assigned to the gray scale of each pixel based on the image signal from the lookup table 151, and controls the power supply 140 to supply electric power corresponding to the read current or voltage level to the display unit 130.

The storage unit 150 is accessed by the controller 160, and reading/recording/modifying/deleting/updating of the data is performed in the storage unit 150 by the controller 160. The storage unit 150 is achieved by a flash memory, a hard disk drive (HDD), or the like nonvolatile storage medium.

The controller 160 performs control operations about various configurations of the display apparatus 100. For example, the controller 160 controls the image processing performed by the image processor 120 to proceed, and performs a control operation corresponding to a command from a remote controller, thereby controlling general operations of the display apparatus 100.

For example, the controller 160 may be achieved by combination of firmware/software in a central processing unit.

The image processor 120 according to an exemplary embodiment is controlled by the controller 160 to refresh and process an image signal per frame.

The controller 160 divides one frame into a plurality of sub-frames (hereinafter, also referred to as sub-fields), i.e., by a time basis with regard to the image signal corresponding to a frame provided in accordance with a plurality of pixels. Here, the number of sub-frames per frame may correspond to the number of driving bits of the image signal. That is, in order to display an image of n bits, one frame is divided into n sub-frames. For example, if the number of driving bits is 4 bits or 8 bits, the number of sub-frames per frame is four or eight.

The controller 160 assigns a predetermined bit weight to each of the divided sub-frames, and controls the power supply 140 to adjust the voltage supplied to the display unit 130 by the assigned bit weight in accordance with the respective sub-frame sections.

Figure 4:
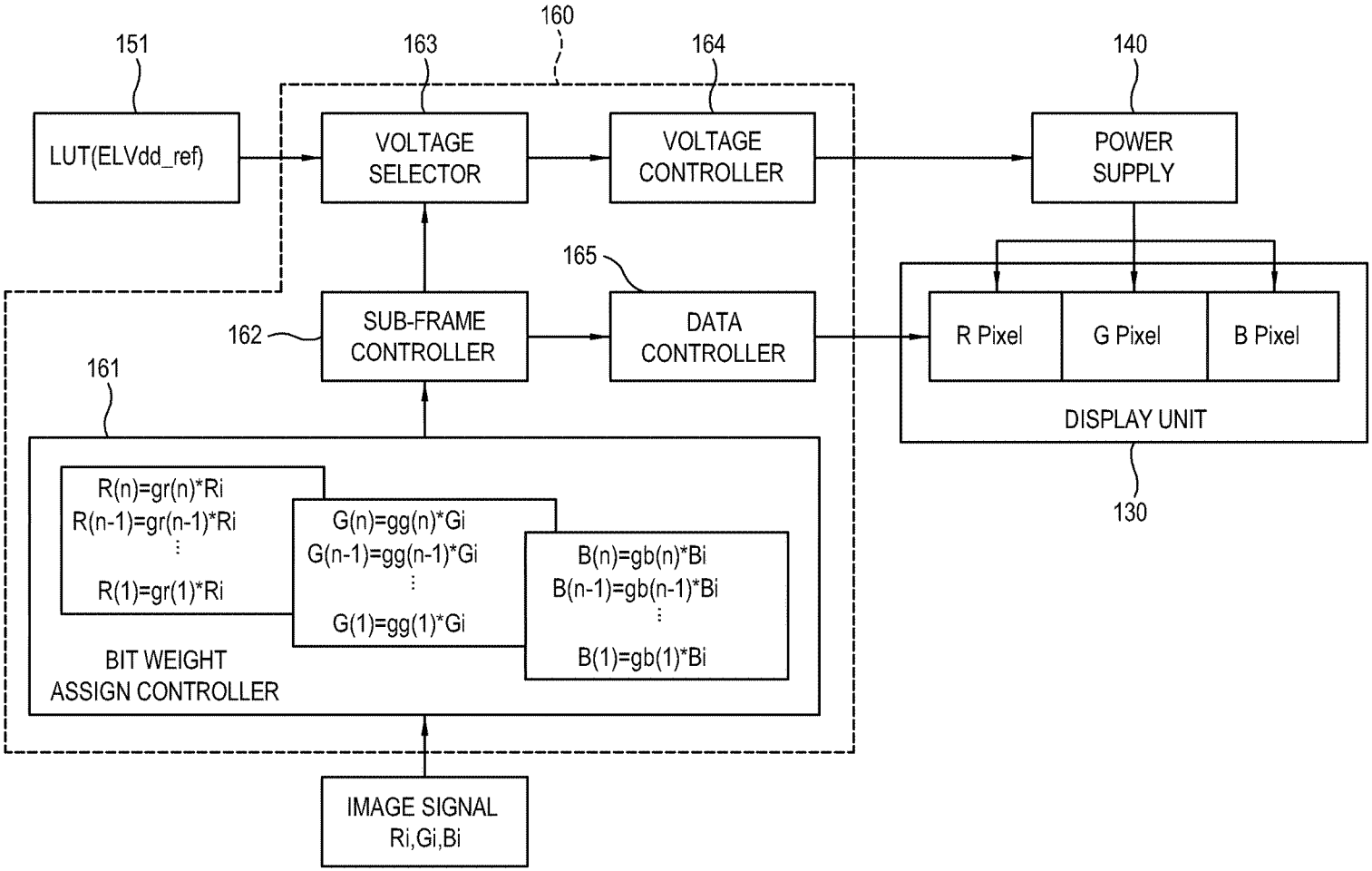
FIG. 4 is a view showing a detailed configuration of a controller according to an exemplary embodiment.
Figure 5:
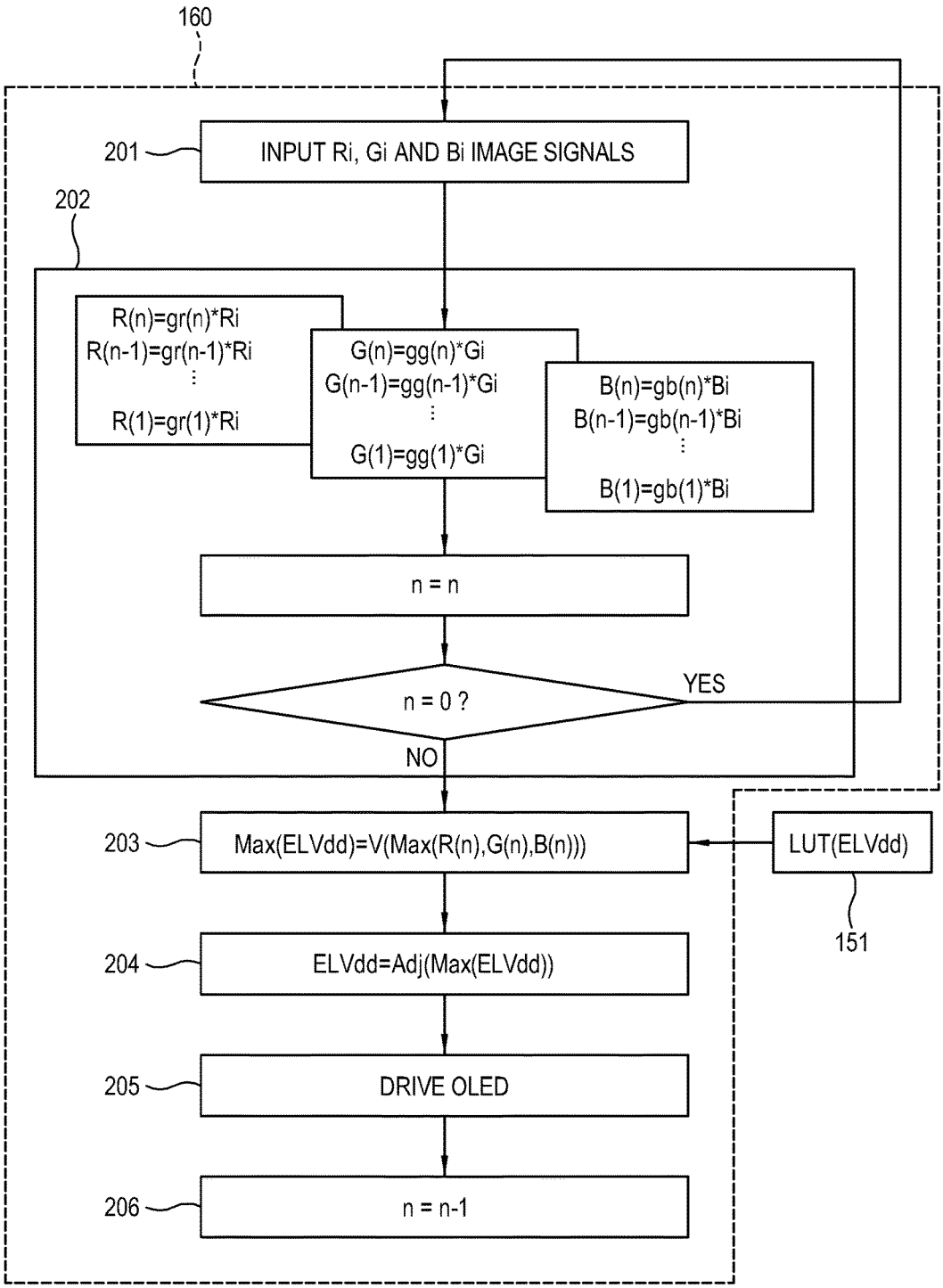
FIG. 5 is a view showing sequential operations of the controller of FIG. 4.

FIG. 4 is a view showing a detailed configuration of the controller 160 according to an exemplary embodiment, and FIG. 5 is a view showing sequential operations of the controller 160 of FIG. 4.

As shown in FIG. 4, the controller 160 includes a bit weight assign controller 161, a sub-frame controller 162, a voltage selector 163, a voltage controller 164, and a data controller 165.

The bit weight assign controller 161 assigns a bit weight to each sub-frame. Here, the bit weight may be determined based on gray scales of a pixel of a corresponding sub-frame.

As shown in FIGS. 4 and 5, the controller 160 receives input image signals Ri, Gi, Bi from an image source (operation 201). Here, each of the Ri, Gi and Bi corresponds to current levels of a red pixel, a green pixel, and a blue pixel of the image signal.

The bit weight assign controller 161 assigns a predetermined bit weight to the received image signal, and assigns current levels R(n)~R(1), G(n)~G(1), and B(n)~B(1) each of which corresponds to sub-frames of R, G and B pixels (operation 202). Here, n~1 refer to sub-frame numbers, which are increased or decreased in sequence of the 1st sub-frame (at n=n), the 2nd sub-frame (at n=n−1), . . . , and the nth sub-frame (at n=0). Also, gr(n)~gr(1) refer to current gains of red pixels corresponding to sub-frames, gg(n)~gg(1) refer to current gains of green pixels corresponding to sub-frames, and gb(n)~gb(1) refer to current gains of blue pixels corresponding to sub-frames, which are used as weights assigned to R, G, and B pixels in accordance with the sub-frames.

Referring to FIG. 5, in the 1st sub-frame section, the bit weight assign controller 161 operates R(n), G(n), and B(n) obtained by assigning gr(n), gg(n), gb(n) as the bit weights to the R, G, and B pixels, respectively. The sub-frame controller 162 determines R(n), G(n), and B(n) as values to which the bit weight is assigned with regard to the image signal of the 1st sub-frame. The current levels, to which the bit weights are assigned in accordance with the respective pixels, are transmitted to the voltage selector 163 through the sub-frame controller 162.

The voltage selector 163 determines a voltage ELVdd supplied during the 1st sub-frame section, referring to the lookup table 151 with respect to the current levels R(n), G(n) and B(n), to which the bit weights are assigned (operation 203). Here, ELVdd is a driving voltage supplied in common to the OLED cells during the 1st sub-frame section. That is, the maximum voltage V(Max(R(n),G(n),B(n))) among the voltages stored in the lookup table 151 may be selected as ELVdd. Therefore, the voltage corresponding to the pixel to which the highest bit weight is assigned among the R, G and B pixels may be supplied during the sub-frame section. Taking this into account, the bit weight assign controller 161 may assign the bit weight to get the minimum difference in voltage between the previous sub-frame and the current sub-frame.

The voltage controller 164 performs voltage scaling to adjust the driving voltage with the maximum voltage (ELVdd=Adj(Max(ELVdd))) determined as above (operation 204), and controls the power supplier 140 to supply the adjusted voltage to the display unit 130, and thus the OLED may be operated during t the $1^{st}$ sub-frame section (operation 205).

Meanwhile, the sub-frame controller 162 transmits an image signal corresponding to the $1^{st}$ sub-frame to the data controller 165, and the data controller 165 controls the image processor 120 and the display unit 130 to display an image corresponding to the image signal during the 1st sub-frame section.

Further, the operations 202 to 205 are performed at the next sub-frame, i.e., the $2^{nd}$ sub-frame section (n=n−1) (operation 206).

For example, in 2nd sub-frame section, the bit weight assign controller 161 operates R(n−1), G(n−1), and B(n−1) obtained by assigning gr(n−1), gg(n−1), and gb(n−1) as the bit weights to the R, G, and B pixels, respectively. The sub-frame controller 162 determines R(n−1), G(n−1), and B(n−1) as values to which the bit weight is assigned with regard to the image signal of the $2^{nd}$ sub-frame. The current levels, to which the bit weights are assigned in accordance with the respective pixels, are transmitted to the voltage selector 163 through the sub-frame controller 162.

The voltage selector 163 determines a voltage ELVdd supplied during the $2^{nd}$ sub-frame section, referring to the lookup table 151 with respect to the current levels of R(n−1), G(n−1), and B(n−1), to which the bit weights are assigned (operation 203). Here, ELVdd is a driving voltage supplied in common to the OLED cells during the $2^{nd}$ sub-frame section. That is, the maximum voltage V(Max(R(n−1),G(n−1),B(n−1))) among the voltages stored in the lookup table 151 may be selected as ELVdd. Therefore, the voltage corresponding to the pixel to which the highest bit weight is assigned among the R, G and B pixels may be supplied during the sub-frame section.

The voltage controller 164 performs voltage scaling to adjust the driving voltage with the maximum voltage (ELVdd=Adj(Max(ELVdd))) determined as above (operation 204), and controls the power supply 140 to supply the adjusted voltage to the display unit 130, and thus the OLED may be operated during the $2^{nd}$ sub-frame section (operation 205).

The voltage variations and control operations 202 to 205 are sequentially performed up to the last sub-frame, i.e., until n=0 (operation 206).

Meanwhile, in the exemplary embodiment shown in FIGS. 4 and 5, the current levels are operated by assigning bit weights to the respective sub-frames, and the voltage levels corresponding to the operated current levels are determined referring to the lookup table in accordance with the respective sub-frames, but not limited thereto. Alternatively, the bit weights may be assigned in accordance with the respective sub-frames, the lookup table may be used to determine the voltage levels corresponding to the assigned bit weight, and the voltages supplied to the respective sub-frames may undergo scaling in accordance with the determined voltage levels. Further, the bit weights may be assigned in accordance with the respective sub-frames, the lookup table may be used to determine the current levels corresponding to the assigned bit weights, and the voltages corresponding to the relevant currents may undergo the scaling in accordance with the respective sub-frames.

Below, an exemplary embodiment where the bit weights are assigned in accordance with the respective sub-frames will be described with reference to FIGS. 6 to 13.

Figure 6:
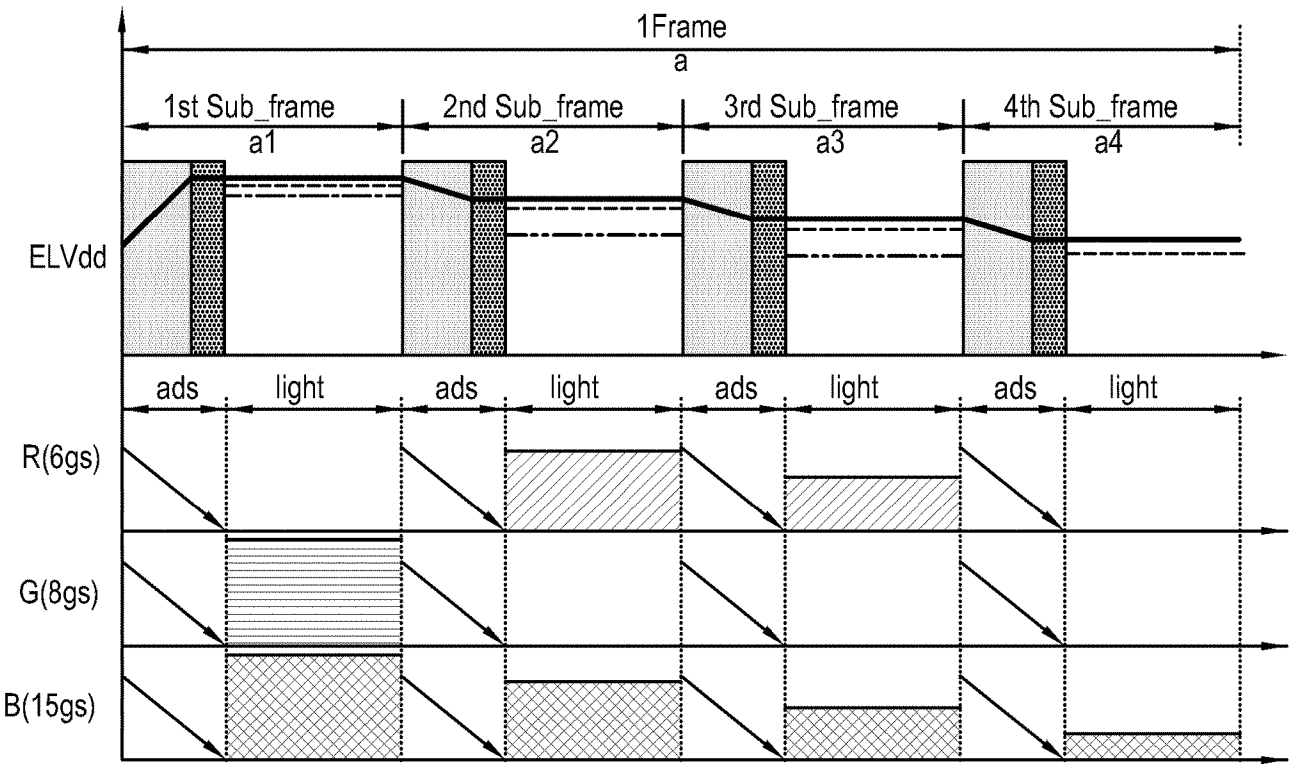
FIGS. 6 and 7 are views illustrating exemplary embodiments that a voltage supplied to the display unit during one frame section is adjusted according to an exemplary embodiment.
Figure 7:
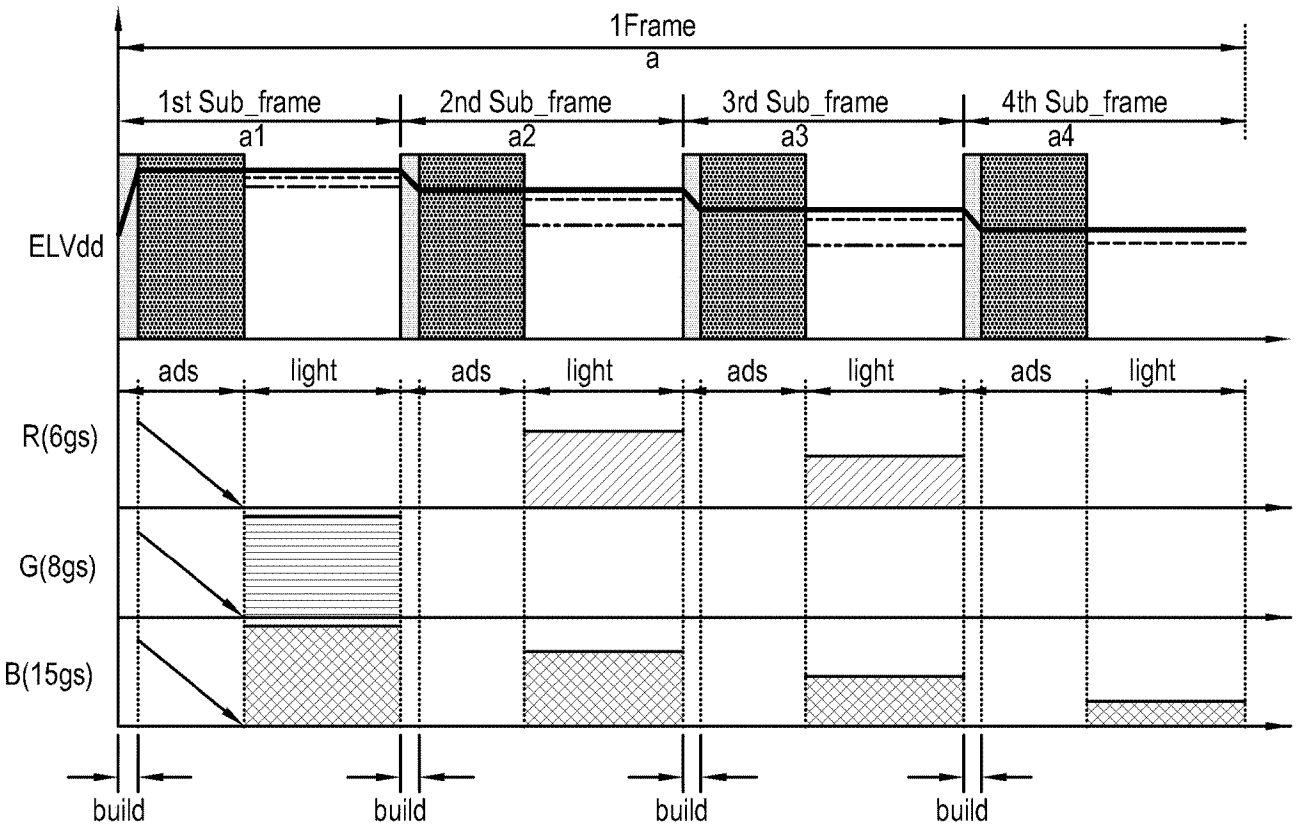

FIGS. 6 and 7 show exemplary embodiments where a voltage supplied to the display unit during one frame section is adjusted. In FIGS. 6 and 7, 4 bits operations are illustrated by way of an example, in which four sub-frames (or four sub-fields) constitute one frame.

As shown in FIG. 6, if each of B, G, and R represents gray scales of 15 gs, 8 gs, and 6 gs, respectively, during a corresponding frame (i.e., 1 frame), the bit weight assign controller 161 may assign a predetermined bit weights to each of the $1^{st}$ to $4^{th}$ sub-frames so that the B OLED may emit light during all the sub-frame sections (gb(4)~gb(1)). Here, the bit weight assign controller 161 may assign the bit weight so that a current level of a present bit (e.g., the $2^{nd}$ sub_frame) may be determined to correspond to half a current level of a previous bit(e.g., the $1^{st}$ sub_frame). That is, if B represents a gray scale of 15 gs, corresponding weights of 8 gs, 4 gs, 2 gs, and 1 gs may be assigned to the $1^{st}$ to $4^{th}$ sub-frames, respectively.

Also, the bit weight assign controller 161 may assign a bit weight of 8 gs to the $1^{st}$ sub-frame so that the G OLED may emit light during the $1^{st}$ sub-frame section, i.e., the most significant bit (MSB) section (gg(4)-gg(1)). Similarly, the bit weight assign controller 161 may assign bit weights of 4 gs and 2 gs to the $2^{nd}$ and $3^{rd}$ sub-frames, respectively, so that the R OLED may emit light during the $2^{nd}$ and $3^{rd}$ sub-frames (gr(4)-gr(1)).

Here, in the embodiment of FIG. 6, it will be appreciated that the maximum bit weight is assigned to the B and G pixels among the R, G, B pixels during the $1^{st}$ sub-frame section, the maximum bit weight is assigned to the B and R pixels during the $2^{nd}$ and $3^{rd}$ sub-frames, and the maximum bit weight is assigned to the B pixels during the $4^{th}$ sub-frame section. Therefore, the common driving voltage ELVdd may be determined by the voltages of the pixels which are different in accordance with the respective sub-frames.

As shown in FIG. 6, each sub-frame (i.e., each of the $1^{st}$ to $4^{th}$ sub-frames) includes an address section (ads) where a weight is assigned to write brightness information about a light emitting cell in accordance with varied voltages and a light section (light) where an actual brightness is expressed using the brightness information written during the address section.

Specifically, during each address section (ads) of the $1^{st}$ to $4^{th}$ sub-frames, the weight is assigned to change the voltage with regard to the previous sub-frame, and S1 shown in FIG. 1 is set up to Low so that the capacitors C1, C2, and C3 may be charged with electric charges of the changed voltage. Thus, during each light section (light) of the $1^{st}$ to $4^{th}$ sub-frames, the light emitting cells OLED (R), OLED (G), and OLED (B) emit light with the electric charges charged in the capacitors C1, C2, and C3 during the address section.

Referring to FIG. 7, each of the $1^{st}$ to $4^{th}$ sub-frames may further include a voltage build section (build) in addition to the address section (ads) and the light section (light).

In each sub-frame according to this exemplary embodiment, the weight is assigned during the voltage build section (build) so as to change the voltage and write the brightness information about the light emitting cell, the changed voltage is stabilized during the address section (ads), and the R, G, and B pixels emit light in accordance with the written brightness information during the light section (light).

Specifically, during each voltage build section (build) of the $1^{st}$ to $4^{th}$ sub-frames, the voltage is changed with respect to the previous sub-frame in accordance with the weight assignment. During the address section (ads), S1 shown in FIG. 1 is set up to Low so that the capacitors C1, C2, and C3 may be charged with electric charges of the changed voltages. During each light section (light) of the $1^{st}$ to $4^{th}$ sub-frames, the light emitting cells OLED (R), OLED (G), and OLED (B) emit light with the electric charges charged in the capacitors C1, C2, and C3 during the address section.

Figure 8:
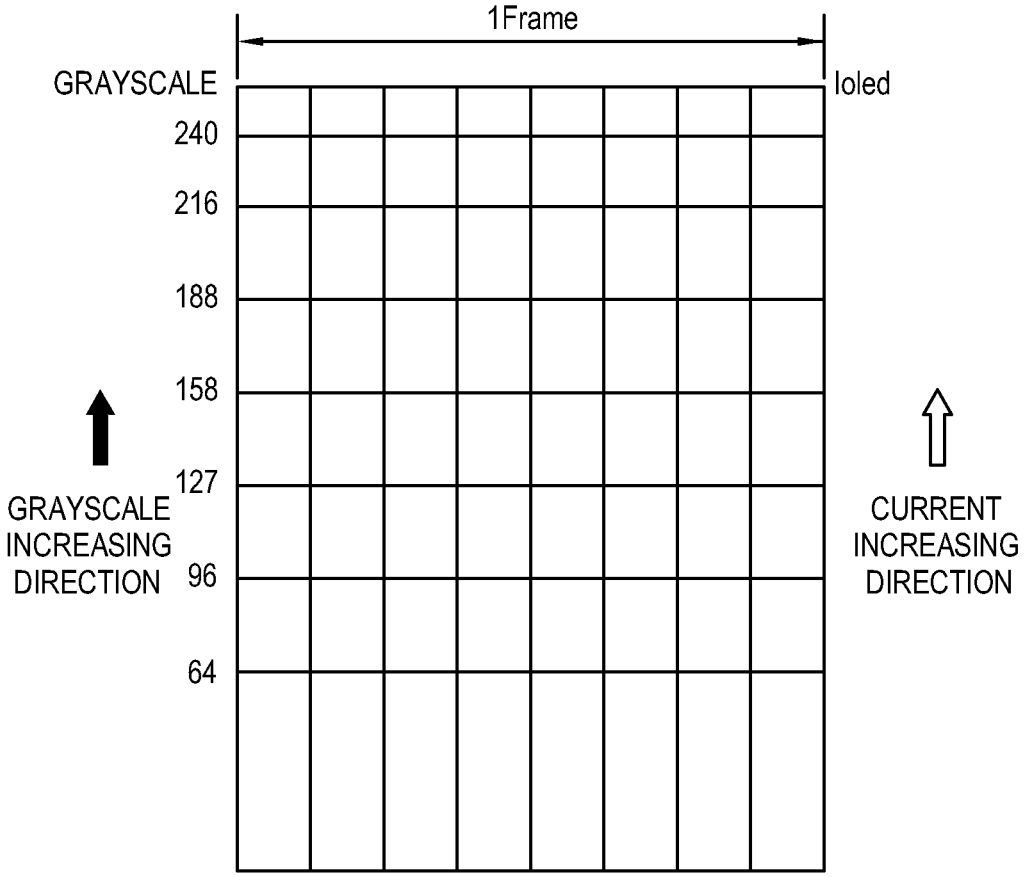
FIGS. 8 and 9 show a conventional OLED display apparatus and an OLED display apparatus according to an exemplary embodiment for explaining variations in a level of electric current applied to an OLED display unit by increasing of a gray scale in the case where a driving bit number for an image signal is 8 bits.
Figure 9:
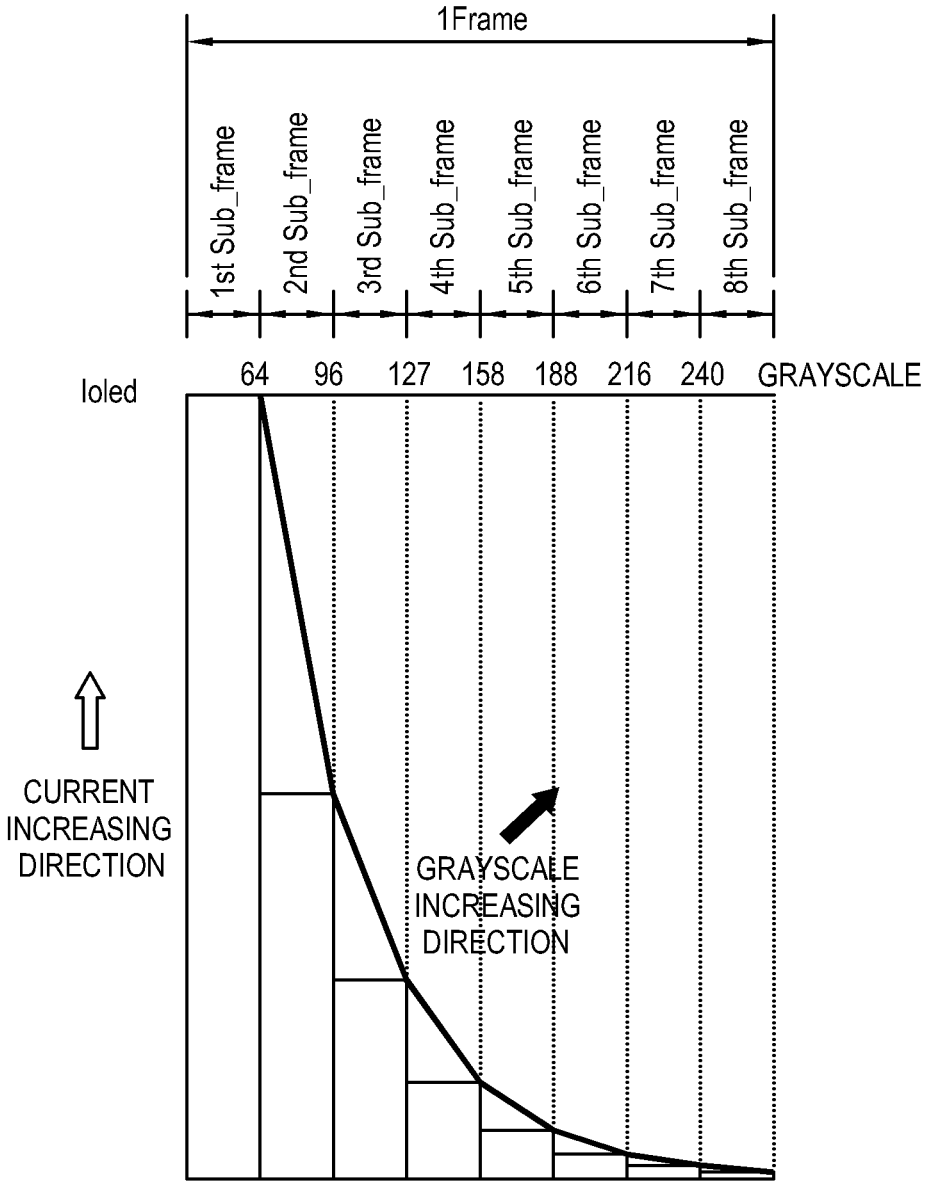

FIGS. 8 and 9 show a conventional OLED display apparatus and an OLED display apparatus according to an exemplary embodiment for explaining variations in a level of electric current applied to an OLED display unit by increasing of a gray scale in the case where a driving bit number for an image signal is 8 bits.

As shown in FIG. 8, in the conventional OLED display apparatus, an increasing direction of the gray scale is the same as an increasing direction of the current holed flowing in the display unit, and the current is constantly supplied without variation during one frame. Here, the level of the current supplied during one frame of FIG. 8 is equal to the level of the current supplied during the $1^{st}$ sub-frame section in the exemplary embodiment of FIG. 9.

Referring to FIG. 9, in the OLED display apparatus 100 according to an exemplary embodiment, an increasing direction of the gray scale is not the same as an increasing direction of the current holed flowing in the display unit.

Specifically, in the case of 8-bit driving operation, one frame is divided into 8 sub-frames (i.e., the $1^{st}$ to $8^{th}$ sub-frames), and bit weight is assigned to each sub-frame so that the current level may be varied in accordance with the respective sub-frames. For example, a current level of the present sub-frame (e.g., the $2^{nd}$ sub-frame) may be determined to correspond to half a current level of the previous sub-frame (e.g., the $1^{st}$ sub-frame).

The display unit 130 of the OLED display apparatus 100 according to this exemplary embodiment is driven by a dynamic voltage and a frequency scaling (DVFS) method where a driving voltage is varied depending on currents determined in accordance with the respective sub-frames. Therefore, the increase of the current supplied to one frame becomes smaller than the increase of the gray scale. Accordingly, difference between the driving voltages ELVdd and Vf is reduced in the OLED cells during each of the sub-frames as compared with that of the conventional OLED display apparatus as shown in FIG. 8, thereby reducing the power consumed in each OLED cell during one frame.

In the display apparatus 100 according to an exemplary embodiment, the gain (i.e., the amplitude or level) of the current may be adjusted (e.g., scaling) in accordance with the respect sub-frames (i.e., $1^{st}$ to $4^{th}$ sub-frames or $1^{st}$ to $8^{th}$ sub-frames) so that the driving voltage may be supplied to the display unit 130. Therefore, the power consumption, in which the power corresponding to the maximum gray scale of a certain pixel (e.g., B) is supplied during one frame, is reduced as compared with that of the conventional OLED display apparatus, thereby preventing the temperature of the panel from increasing.

In the foregoing embodiment, the voltage ELVdd supplied to each sub-frame is determined according to the gray scale of the pixel B, but not limited thereto. Alternatively, the voltage supplied to each sub-frame may be determined according to the gray scale of the pixel R or G. Also, the above embodiment describes the OLED display apparatus includes the OLED cells corresponding to the R, G, and B pixels, but not limited thereto. Alternatively, another OLED cell, for example, a white pixel W may be added to the R, G, and B pixels. In this case, the voltage supplied to each sub-frame may be determined according to the gray scale of a pixel among the R, G, B, and W pixels.

Meanwhile, the controller 160 may readjust the voltage by adding a predetermined value $\alpha$ to the voltage level scaled by the bit weight assigned in accordance with the respective sub-frames. For example, the voltage selector 163 reads a voltage level corresponding to a current level, to which the bit weight is reflected in accordance with the gray scales, from the lookup table 151, and selects a voltage, which is re-adjusted by adding a predetermined value $\alpha$ to the read voltage level, to be supplied to each sub-frame. Here, the predetermined value $\alpha$ is previously determined as a value smaller than the level of the voltage supplied in accordance with the respective sub-frames as shown in FIGS. 6 and 7, and stored in the lookup table 151. The driving voltage is readjusted as above, thereby supplying a more stable driving voltage to the display unit 130.

In this embodiment, the bit weight is assigned so that difference in voltage between the previous sub-frame and the current sub-frame may be minimized. For example, in the embodiments shown in FIGS. 6, 7 and 9, the highest weight is assigned during the most significant bit (MSB) section, i.e. the first bit, among the plurality of sub-frames, the lowest weight is assigned during the least significant bit (LSB) section, i.e. the last bit, among the plurality of sub-frames, and the bit weight is assigned so that the current level of the present bit corresponds to half the current level of the previous bit, but not limited thereto. Alternatively, the bit weight assigned to each sub-frame may be changed variously.

Below, various embodiments of assigning the weight to each sub-frame will be described with reference to FIGS. 10 to 13.

FIGS. 10 to 13 show variations in voltage applied to the display unit 130 in accordance with respective sub-frames for successive two frames according to an exemplary embodiment. FIGS. 10 to 13 illustrate a 4-bit driving operation, in which each of two successive frames (e.g., a $1^{st}$ frame (a) and a $2^{nd}$ frame (b)) includes four sub-frames.

Figure 10:
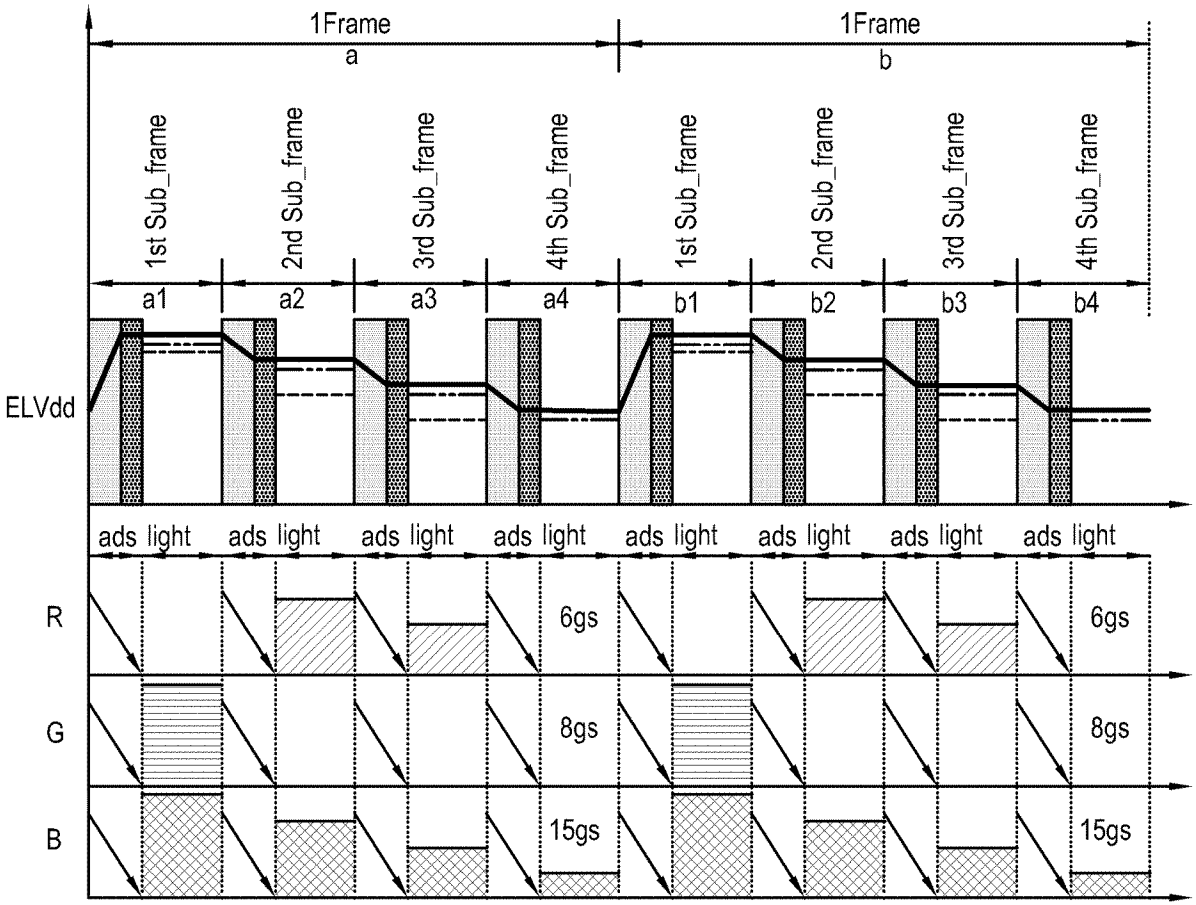
FIGS. 10 to 13 show variations in voltage applied to the display unit in accordance with respective sub-frames for successive two frames according to an exemplary embodiment.

Referring to FIG. 10, two successive frames, i.e., the $1^{st}$ frame (a) and the $2^{nd}$ frame (b), may be driven by the most significant bit (MSB) method in which the highest weight is assigned to the most significant bit (MSB) section, i.e., the $1^{st}$ sub-frames a1 and b1 to supply the highest voltage, and the lowest weight is assigned to the least significant bit (LSB) section, i.e., the $4^{th}$ sub-frames a4 and b4 to supply the lowest voltage.

Figure 11:
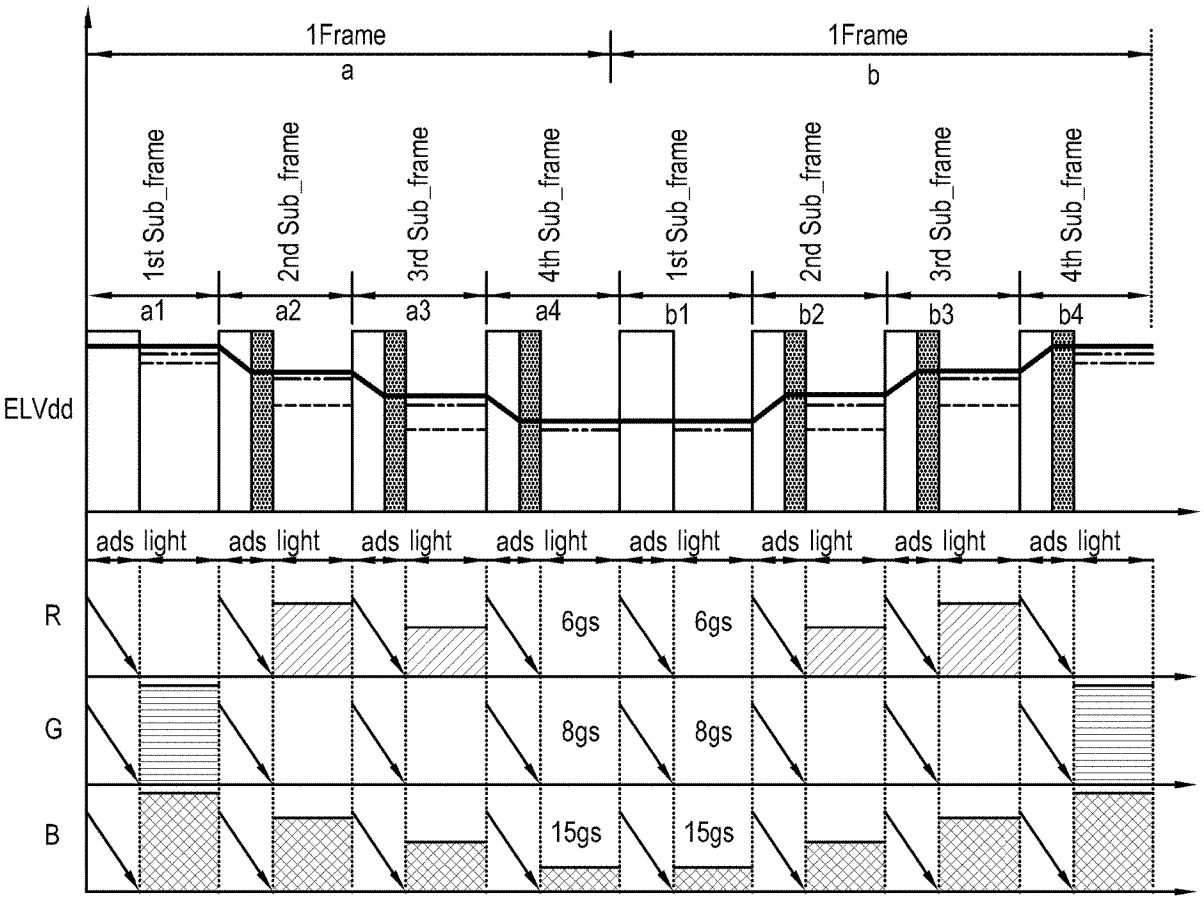

Referring to FIG. 11, the $1^{st}$ frame (a) may be driven by the MSB method in which the highest weight is assigned to the MSB section, i.e., the $1^{st}$ sub-frame a1 to supply the highest voltage and the lowest weight is assigned to the (LSB section, i.e., the $4^{th}$ sub-frame a4 to supply the lowest voltage, but the $2^{nd}$ frame (b) may be driven by the LSB method in which the lowest weight is assigned to the MSB section, i.e., the $1^{st}$ sub-frame b1 to supply the lowest voltage and the highest weight is assigned to the LSB section, i.e., the $4^{th}$ sub-frame b4 to supply the highest voltage.

In the embodiment of FIG. 11, the same weight is assigned to each of the R, G, and B pixels in the last sub-frame a4 of the $1^{st}$ frame (a) and the $1^{st}$ sub-frame b1 of the second frame (b). Thus, since the same voltage is supplied to the successive sub-frames a4 and b1, there is no need of changing the voltage even though the sub-frame section is changed from a4 to b1. Therefore, the number of changes for the voltage due to the change between the sub-frame sections is reduced, thereby a control load for power supply in the controller 160 is decreased.

The embodiment of FIG. 11 illustrates that the voltage is varied depending on the sub-frames by alternating between the MSB method and the LSB method to drive two successive frames, but not limited thereto. Alternatively, a method of minimizing the number of change for voltage may be applied to three or more successive frames. For example, the sub-frames included in four successive frames may be driven by the MSB, LSB, MSB, and LSB methods in sequence. Alternatively, four successive frames may be driven by the MSB, LSB, LSB and MSB methods in sequence, or the LSB, MSB, MSB and LSB methods in sequence.

Figure 12:
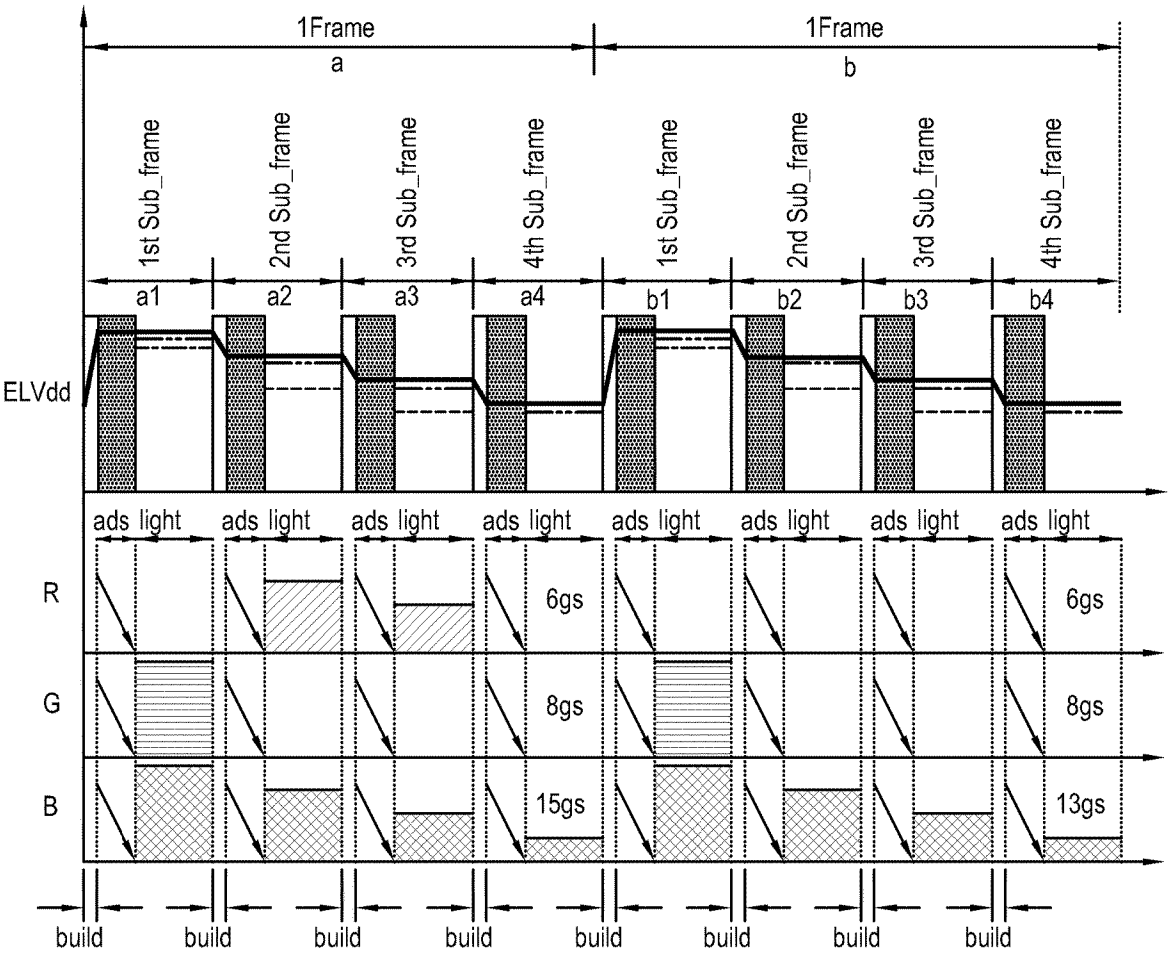
Figure 13:
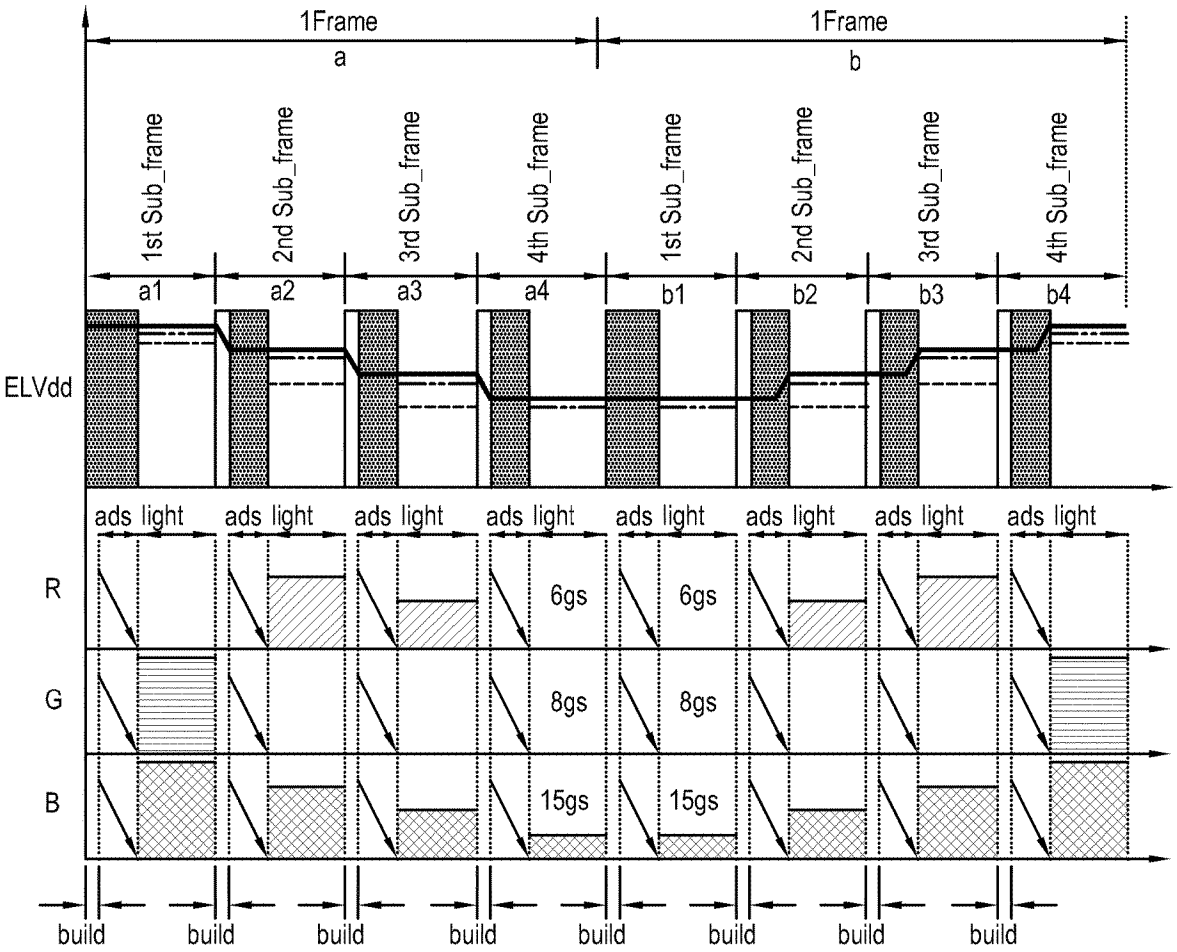

The sequential driving methods shown in FIGS. 10 and 11 are applicable to the embodiments including the additional build section (build) as shown in FIGS. 12 and 13.

Referring to FIG. 12, two frames, i.e., the $1^{st}$ frame (a) and the $2^{nd}$ frame (b), may be driven by the MSB method where the highest weight is applied to the most significant bit (MSB) section, i.e., the $1^{st}$ sub-frames a1 and b1 to supply the highest voltage, and the lowest weight is applied to the lowest significant bit section (LSB), i.e., the $4^{th}$ sub-frames a4 and b4 to supply the lowest voltage.

Referring to FIG. 13, the $1^{st}$ frame (a) may be driven by the MSB method in which the highest weight is assigned to the most significant bit (MSB) section, i.e., the $1^{st}$ sub-frame a1 to supply the highest voltage and the lowest weight is assigned to the least significant bit (LSB) section, i.e., the $4^{th}$ sub-frame a4 to supply the lowest voltage, but the $2^{nd}$ frame (b) may be driven by the LSB method in which the lowest weight is assigned to the most significant bit (MSB) section, i.e., the $1^{st}$ sub-frame b1 to supply the lowest voltage and the highest weight is assigned to the least significant bit (LSB) section, i.e., the $4^{th}$ sub-frame b4 to supply the highest voltage.

The same weight is assigned to each of the R, G, and B pixels in the last sub-frame a4 of the $1^{st}$ frame (a) and the $1^{st}$ sub-frame b1 of the second frame (b). Thus, since the same voltage is supplied to the successive sub-frames a4 and b1, there is no need of changing the voltage even though the sub-frame section is moved from a4 to b1. Therefore, the number of changes for the voltage due to the move between the sub-frame sections is reduced, thereby a control load for power supply in the controller 160 is decreased.

Below, a control method of the display apparatus 100 according to an exemplary embodiment will be described with reference to FIG. 14.

Figure 14:
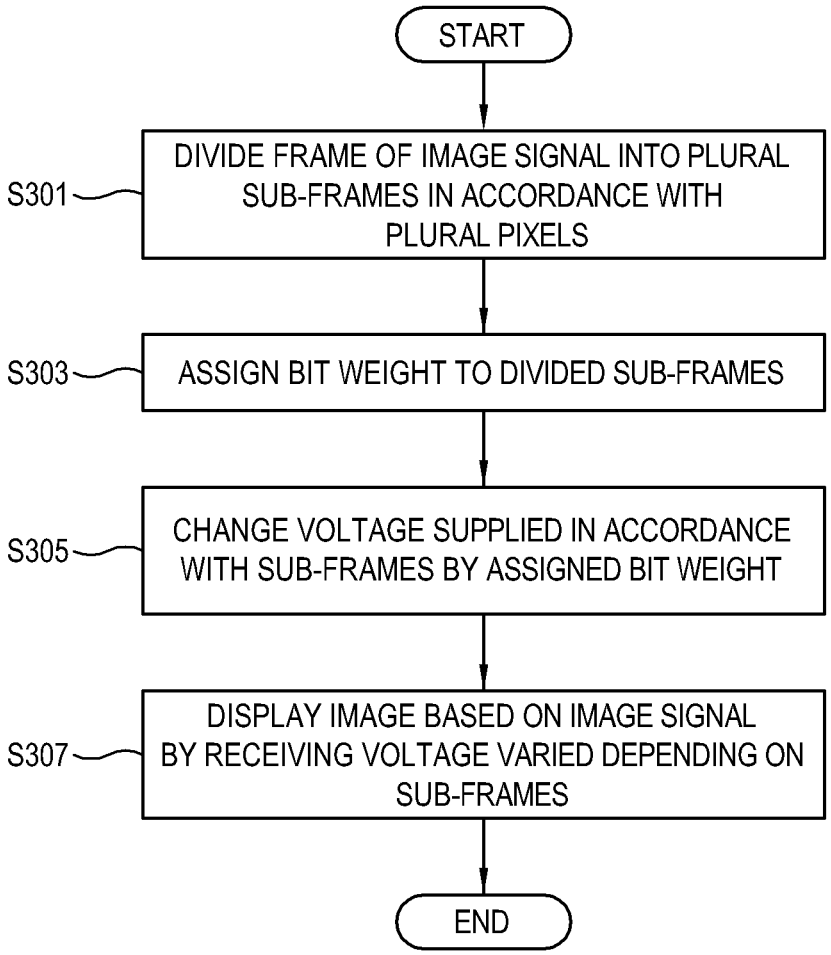
FIG. 14 is a flowchart showing a control method of the display apparatus according to an exemplary embodiment.

FIG. 14 is a flowchart showing the control method of the display apparatus 100 according to an exemplary embodiment.

The OLED display apparatus 100 divides a frame of an image signal into a plurality of sub-frames in accordance with a plurality of pixels R, G, and B including OLED (S301). Here, the number of sub-frames included in one frame corresponds to the number of driving bits for the image signal to be processed by the display apparatus 100. For example, in the case of a 4-bit driving operation, one frame is divided into four sub-frames, and in the case of a 8-bit driving operation, one frame is divided into eight sub-frames.

The controller 160 assigns the bit weight to the divided sub-frames (S303). Here, the bit weight may be determined in accordance with the gray scales of the pixel for the corresponding frame.

The controller 160 may assign the highest bit weight during the most significant bit section of the sub-frame, and assign the lowest bit weight during the least significant bit section of the sub-frame. Here, the controller 160 may assign the bit weight so that the difference in voltage between the previous sub-frame and the current sub-frame may be minimized. For instance, half a weight assigned to the previous bit may be assigned to the present bit.

Alternatively, the controller 160 may assign the highest bit weight to the least significant bit section of the sub-frame, and assign the lowest bit weight to the most significant bit section of the sub-frame. In this case, the bit weight may be assigned so that the number of change for voltage of the current sub-frame with respect to the previous sub-frame is minimized. For instance, twice as high as a weight assigned to the previous may be assigned to the present bit.

The controller 160 may control the power supply 140 so that the voltages supplied corresponding to the sub-frames may be changed in accordance with the bit weights (S305). Here, the controller 160 may determine the voltage levels referring to the lookup table 151 in the storage unit 150 in accordance with respective R, G, and B pixels, and adjust the voltage so that the maximum voltage (i.e., the voltage of the pixel to which the highest bit weight is assigned) may be supplied during the corresponding sub-frame section. Also, the controller 160 readjust the voltage by adding a predetermined setup value $\alpha$ to the level of the voltage adjusted in the operation S305.

The controller 160 receives the adjusted voltage in accordance with the sub-frames, and controls the display unit 130 to display an image based on the image signal (S307).

In the foregoing exemplary embodiment, the OLED display apparatus is achieved by an active matrix (AM) OLED display apparatus, but not limited thereto. Alternatively, the exemplary embodiment is achieved by a passive matrix (PM) method.

As described above, according to an exemplary embodiment, the display apparatus 100 with the display unit 130 including an organic light emitting diode (OLED) performs gain control in accordance with respective sub-frames, thereby changing of a driving voltage and power consumption of the display apparatus may be reduced.

While not restricted thereto, the exemplary embodiments may be written as computer programs and may be implemented in general-use digital computers that execute the programs using a computer readable recording medium. Examples of the computer readable recording medium include magnetic storage media (e.g., ROM, floppy disks, hard disks, etc.) and optical recording media (e.g., CD-ROMs, or DVDs). Also, the exemplary embodiments may be written as computer programs transmitted over a computer-readable transmission medium, such as a carrier wave, and received and implemented in general-use digital computers that execute the programs. Moreover, while not required in all aspects, one or more units of the apparatus can include a processor or microprocessor executing a computer program stored in a computer-readable medium, such as a local storage.

Although the exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus comprising:

a display configured to comprise a plurality of pixels with an organic light emitting diode (OLED), each of the plurality of pixels comprising red (R), green (G), and blue (B) pixels;

a power supply configured to supply power to the display;

an image processor configured to process an image signal to be displayed on the display in accordance with the plurality of pixels; and a controller configured:

to assign a plurality of sub-frames divided from a frame of the image signal to the each of the plurality of pixels, to drive a pixel so that a sum of output values of the pixel at the plurality of sub-frames corresponds to a brightness of the pixel at the frame, wherein the output values of the pixel at the plurality of sub-frames are predetermined and different from one other, and to control the power supply to supply a voltage to the pixel at each of the plurality of sub-frames so that a magnitude of the voltage changes according to the output value of the pixel at the each of the plurality of sub-frames, wherein the controller is further configured to control the power supply to supply a voltage having a same magnitude to the pixel at a last sub-frame of a first frame and at a first sub-frame of a second frame, the last sub-frame of the first frame and the first sub-frame of the second frame being successive.

2. The display apparatus according to claim 1, wherein the number of sub-frames constituting one frame corresponds to the number of driving bits for the image signal.

3. The display apparatus according to claim 1, wherein the output values of the pixel at the plurality of sub-frames are determined according to a gray scale of the pixel of a corresponding frame.

4. The display apparatus according to claim 3, further comprising a storage configured to store a lookup table in which a voltage magnitude or a current magnitude corresponding to the output values of the pixel at the plurality of sub-frames determined in accordance with the gray scale of the pixel is set up.

5. The display apparatus according to claim 1, wherein the controller drives the pixel so that a sub-frame has a maximum voltage in a most significant bit section of the sub-frame and a minimum voltage in a least significant bit section of the sub-frame.

6. The display apparatus according to claim 5, wherein the controller drives the pixel so that a voltage of the sub-frame corresponds to half a voltage of a previous sub-frame.

7. The display apparatus according to claim 1, wherein the controller drives the pixel so that a sub-frame has a maximum voltage in a least significant bit section of the sub-frame and a minimum voltage in a most significant bit section of the sub-frame.

8. The display apparatus according to claim 1, wherein the controller drives the pixel so that the number of changes for a voltage of the sub-frame with respect to a voltage of a previous sub-frame is minimized.

9. The display apparatus according to claim 1, wherein the controller drives the pixel so that a difference in voltage between a previous sub-frame and the sub-frame is minimized.

10. The display apparatus according to claim 1, wherein the sub-frame comprises an address section where a voltage is changed and a light section where a pixel emits light.

11. The display apparatus according to claim 1, wherein the sub-frame comprises a voltage build section where a voltage is changed, an address section where the changed voltage is stabilized, and a light section where a pixel emits light.

12. The display apparatus according to claim 1, wherein the controller controls the power supply to readjust voltage by adding a predetermined setup value to a magnitude of the adjusted voltage.

13. The display apparatus according to claim 1, wherein the controller is configured to control the power supply to supply to the R, G, B pixels a common voltage during each of the plurality of the sub-frames, and wherein a magnitude of the common voltage is constant within each of the plurality of the sub-frames.

14. A control method for a display apparatus comprising a display with an organic light emitting diode (OLED), the method comprising:

assigning a plurality of sub-frames divided from a frame of an image signal to each of a plurality of pixels, the each of the plurality of pixels comprising red (R), green (G), and blue (B) pixels;

driving a pixel so that a sum of output values of the pixel at the plurality of sub-frames corresponds to a brightness of the pixel at the frame, wherein the output values of the pixel at the plurality of sub-frames are predetermined and different from one other;

supplying a voltage to the pixel at each of the plurality of sub-frames so that a magnitude of the voltage changes according to the output value of the pixel at the each of the plurality of sub-frames, wherein the supplying a voltage comprises supplying a voltage having a same magnitude to the pixel at a last sub-frame of a first frame and at a first sub-frame of a second frame, the last sub-frame of the first frame and the first sub-frame of the second frame being successive.

15. The method according to claim 14, wherein the number of sub-frames constituting one frame corresponds to the number of driving bits for the image signal.

16. The method according to claim 14, wherein the output values of the pixel at the plurality of sub-frames are determined according to a gray scale of the pixel of a corresponding frame.

17. The method according to claim 16, wherein the supplying the voltage comprises referring to a lookup table in which a voltage magnitude or a current magnitude corresponding to the output values of the pixel at the plurality of sub-frames determined in accordance with the gray scale of the pixel is set up.

18. The method according to claim 14, wherein the driving the pixel comprises driving the pixel so that a sub-frame has a maximum voltage in a most significant bit section of the sub-frame and a minimum voltage in a least significant bit section of the sub-frame.

19. The method according to claim 14, wherein the driving the pixel comprises driving the pixel so that a voltage of the sub-frame corresponds to half a voltage of a previous sub-frame.

20. The method according to claim 14, wherein the driving the pixel comprises driving the pixel so that the sub-frame has a maximum voltage in a least significant bit section of the sub-frame and a minimum voltage in a most significant bit section of the sub-frame.

21. The method according to claim 14, wherein the driving the pixel comprises driving the pixel so that the number of changes for a voltage of the sub-frame with respect to a voltage of a previous sub-frame is minimized.

22. The method according to claim 14, wherein the driving the pixel comprises driving the pixel so that a difference in voltage between a previous sub-frame and the sub-frame is minimized.

23. The method according to claim 14, wherein the sub-frame comprises an address section where a voltage is changed and a light section where a pixel emits light.

24. The method according to claim 14, wherein the sub-frame comprises a voltage build section where a voltage is changed, an address section where the changed voltage is stabilized, and a light section where a pixel emits light.

25. The method according to claim 14, further comprising readjusting voltage by adding a predetermined setup value to a magnitude of the adjusted voltage.

26. A non-transitory computer readable medium having instructions recorded thereon to perform the control method of claim 14.

27. A circuit for a display apparatus having a plurality of pixels, each of the plurality of pixels comprising red (R), green (G), and blue (B) pixels, the circuit comprising:

an image processor configured to process an image signal in accordance with the plurality of pixels; and a controller configured:

to assign a plurality of sub-frames divided from a frame of the image signal to the each of the plurality of pixels, to drive a pixel so that a sum of output values of the pixel at the plurality of sub-frames corresponds to a brightness of the pixel at the frame, wherein the output values of the pixel at the plurality of sub-frames are predetermined and different from one other, and to supply a voltage to the pixel at each of the plurality of sub-frames so that a magnitude of the voltage changes according to the output value of the pixel at the each of the plurality of sub-frames, wherein the controller is further configured to control the power supply to supply a voltage having a same magnitude to the pixel at a last sub-frame of a first frame and at a first sub-frame of a second frame, the last sub-frame of the first frame and the first sub-frame of the second frame being successive.

28. The circuit for the display apparatus according to claim 27, wherein the number of sub-frames constituting one frame corresponds to the number of driving bits for the image signal.

29. The circuit for the display apparatus according to claim 27, wherein the output values of the pixel at the plurality of sub-frames are determined according to a gray scale of the pixel of a corresponding frame.

30. The circuit for the display apparatus according to claim 27, wherein the controller drives the pixel so that the number of changes for a voltage of the sub-frame with respect to a voltage of a previous sub-frame is minimized.

31. The circuit for the display apparatus according to claim 27, wherein the controller drives the pixel so that a difference in voltage between a previous sub-frame and the sub-frame is minimized.

32. The circuit for the display apparatus according to claim 27, wherein the controller readjusts voltage by adding a predetermined setup value to a magnitude of the adjusted voltage.

* * * * *